United States Patent [19]

Moran et al.

[11] 3,991,693

[45] Nov. 16, 1976

[54] SEWING MACHINE DRIVE CONTROL

[75] Inventors: Robert J. Moran, Littleton; Louis P. Marsilia, East Boston, both of Mass.

[73] Assignee: Clinton Industries, Inc., Hackensack, N.J.

[22] Filed: June 2, 1972

[21] Appl. No.: 259,171

Related U.S. Application Data

[63] Continuation-in-part of Ser. No. 153,515, June 16, 1971, abandoned.

[52] U.S. Cl. ..... 112/219 A; 318/269; 112/218 A

[51] Int. Cl.[2] ..... D05B 69/26; H02P 3/12

[58] Field of Search ..... 112/219 A, 219 R, 220, 112/221, 87, 67; 318/301, 269, 369, 375, 380

[56] References Cited

UNITED STATES PATENTS

| | | | |
|---|---|---|---|
| 3,367,296 | 2/1968 | Harruff | 112/219 A |
| 3,466,524 | 9/1969 | Cooper | 318/369 X |
| 3,544,874 | 12/1970 | Dutko et al. | 318/380 |
| 3,573,581 | 4/1971 | Dutko | 112/219 A |
| 3,597,672 | 8/1971 | Seesselberg | 112/220 |

*Primary Examiner*—H. Hampton Hunter
*Attorney, Agent, or Firm*—William R. Liberman

[57] ABSTRACT

A direct motor drive system for a sewing machine wherein a low-inertia direct current motor coupled directly to the drive shaft is excited by a low impedence source of variable direct current voltage derived from a rectified alternating current signal at a manually controllable autotransformer. A needle-positioning circuit senses the needle position and either pulses or brakes the motor electrically so that the needle moves to a selected up or down position.

5 Claims, 9 Drawing Figures

SEWING MACHINE DRIVE CONTROL

CROSS-REFERENCE TO RELATED APPLICATIONS

This application is a continuation-in-part of our application Ser. No. 153,515, filed June 16, 1971 for "Sewing Machine Drive Control" and now abandoned.

BACKGROUND OF THE INVENTION

This invention relates generally to sewing machines and directly concerns a new and improved drive control system for sewing machines wherein an electric motor drive can be controlled at selected speeds and, if required, positioned with reasonable accuracy.

Most common industrial sewing machines in use today were originally equipped with alternating current induction type motors, many of which include integral clutch and brake mechanisms, as well as an inertia-storing flywheel for obtaining faster acceleration and deceleration. During engagement of the motor with the sewing machine drive shaft through the clutch, the inertia of the flywheel supplies energy to bring the machine mechanism toward operating speed. For controlling deceleration, a friction type of brake is often used. Other types of drives may include drive belts and pulleys for coupling the motor to the sewing machine.

Although induction motor drives are still conventional and in wide use, the various mechanical means used to improve their start and stop characteristics are neither entirely effective nor free of frequent mechanical failure. All components, for example, must be able to withstand the impact loads arising from rapid engagement of the clutch. Furthermore, loud noises resulting from operation of the clutch and brake are disturbing to the operators.

Recent developments have been made which avoid many of those shortcomings. To that end, the induction motor and its associated mechanisms were abandoned in favor of low-inertia, direct current motors of the type disclosed in U.S. Pat. No. 2,920,238. These motors have a surface wound rotor, usually comprised of printed circuit windings, which has very little inertia of its own and yet is capable of yielding substantial driving torque. It is thus a characteristic of such motors that they accelerate and decelerate rapidly, even under load.

In the drive systems now known to implement low-inertia direct current drive motors, however, unnecessarily complex and expensive control circuits have provided new complications of their own. Although these drive systems perform well when all components are operating satisfactorily, their complexity has multiplied not only the initial investment in each system, but also the day-to-day maintenance costs. One specific drawback of this complexity is the necessity for highly trained service personnel in case of technical faults and, thus, sewing machine users are not usually able to restore the drive system to working order within a short time after breakdown.

Another disadvantage of the known systems in their requirement for multiple phase power. Many users of sewing machines demand compatability with three-phase power, and those drive systems now in use which have the low inertia dc motors have met that requirement by drawing all power from a three-phase transformer. Also, each phase, after being rectified, drives an SCR which serves as the controllable element between the motor and the power transformer. Various motor speeds are obtained by regulating the conduction duty cycle of the SCR. Two major deficiencies inhere such SCR motor control. First, the switching of the SCR's at times other than the zero crossing point for the ac signal causes large transient spikes to be applied to the motor. Such transients could damage the motor or overload circuit fuses. Second, the discontinuous nature of the drive signal waveform means that large harmonic components are present, which cause joule heating without contributing any useful work.

Circuits in the prior art drive systems for regulating needle positioning have tended to be unusually intricate, incorporating many binary logic elements such as flip-flops, gates, monostable multivibrators and pulse circuits for sensing drive speed. Thus, the needle positioning means has only compounded the complexity of the already complicated drive system. The cost of these systems, for example, may amount to two or three times the cost of a direct drive system according to the invention, and maintenance problems are aggravated.

Most speed control devices for sewing machine drives function by stepping the motor in discrete jumps from one speed to another. Furthermore, most variable speed drive systems have not been readily adaptable to existing equipment and have not provided the wide range of operating speed and control desired by sewing machine operators, and even the improved dc drives may use electromechanical braking to get acceptable stepping and positioning response. In some sewing machine drive control circuits, a rheostat is used to develop a variable control voltage; as is well known, such resistive devices present an appreciable continuous power train, even under no-load or low-load conditions.

A primary object of the invention is therefore to provide a direct drive system for sewing machines and similar equipment which overcomes the many disadvantages associated with systems now known.

Another important object of the invention is to provide a sewing machine drive control which is continuously variable in speed from full stop to maximum speed.

A further object is the provision of a drive control system for sewing machines which is more reliable and far simpler than those of the prior art.

An additional important object of the invention is to improve the needle positioning means for sewing machines and to render such means compatible with the drive control means of the invention.

An improved bobbin winding mechanism is also disclosed.

SUMMARY OF THE INVENTION

These and other objects are attained by a drive system using a high torque, low-inertia direct current motor powered from a low impedence source of variable direct current voltage and coupled directly to the drive mechanism, such as the sewing machine drive shaft. Preferably, the elements of the system, and the motor in particular, are selected to give system mechanical time constant of less than 500 milliseconds and ideally less than from 150 milliseconds to 50 milliseconds.

In a preferred embodiment, variable direct current is developed by the fully rectified output of a variable autotransformer coupled to the operator's foot treadle and connected to the motor through a switch that operates to short the motor and thereby dynamically brake the motor when the treadle is returned to the normal position.

Needle positioning is operative in the preferred embodiment when the operator moves the foot treadle to bring the machine to a stop. At this point, needle positioning circuits apply either positive or negative pulses to the motor to drive it in one direction or the other to a predetermined position sensed by means associated with the motor shaft and housing. Thus the invention provides reversible drive of the motor for homing the needle in the shortest time, and the low mechanical time constant ensures performance of the system at least as acceptable as that reached with electromechanical clutching and braking.

BRIEF DESCRIPTION OF THE DRAWINGS

For a complete understanding of the invention, as well as its further objects and advantages, reference should be made to the following detailed description of preferred embodiments and to the drawings, wherein.

DETAILED DESCRIPTION OF THE PREFERRED EMBODIMENTS

Figure 1:
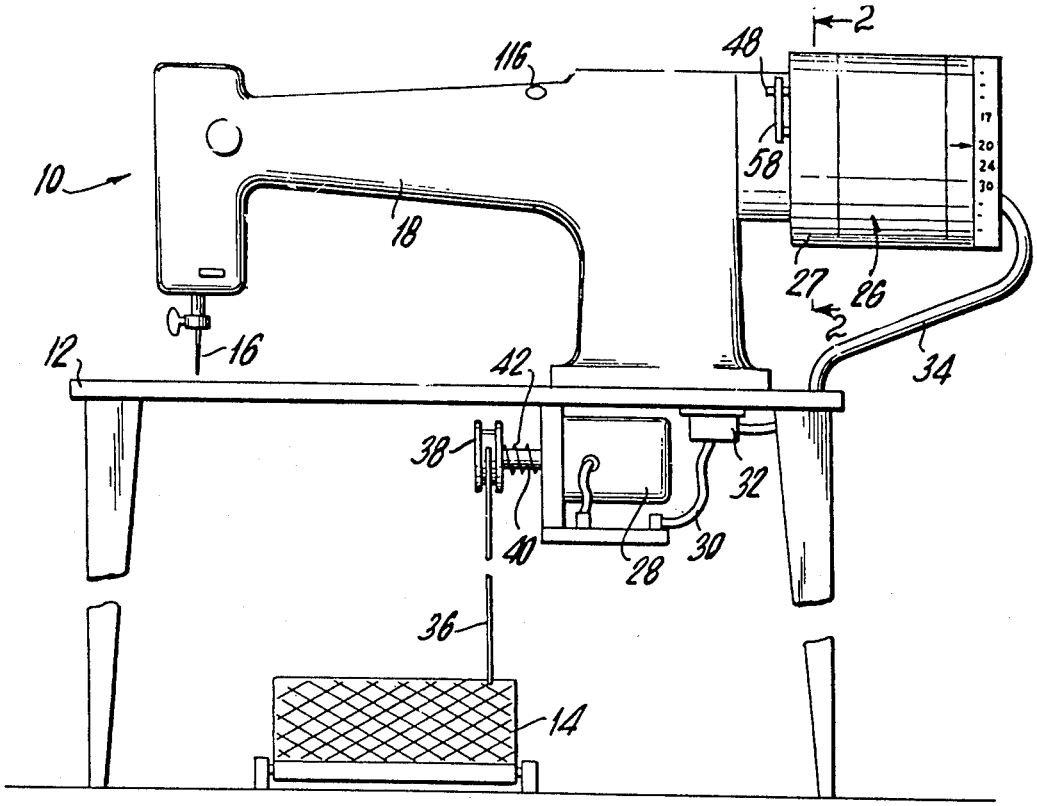
FIG. 1 is a view in front elevation of a representative sewing machine equipped with a drive motor control system made according to the invention.
Figure 5:
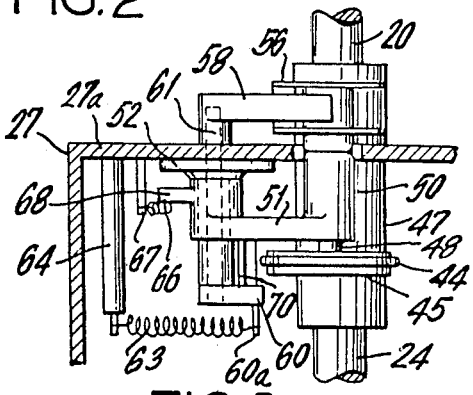
FIG. 5 is a plan view in partial cross-section through the motor housing, showing the bobbin rewind mechanism of FIG. 2.
Figure 4:
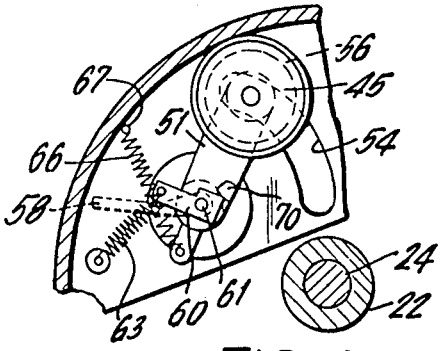
FIG. 4 is a partial side elevation view of the mechanism in FIG. 2, showing the bobbin fully rewound and the mechanism disengaged from the drive coupling.

FIG. 1 shows a typical industrial type of sewing machine 10 mounted on a work table 12 in the usual fashion for control by a floor-level pivoted treadle 14 by which the operator regulates the speed of the machine. The sewing machine includes the usual reciprocating needle 16 directly driven by a motor 26 through gearing within a machine housing 18. Part of the machine drive includes a drive shaft 20 (FIG. 5); the drive motor 26, which is mounted directly to the machine housing 18 for coupling of the motor shaft 24 to the machine drive shaft 20, is the motive source. The motor is contained within a cylindrical housing 27 having a forward end plate 27a and is energized by means of a variable rotary autotransformer 28 carried by the underside of the table 12 and connected by leads 30 to a full-wave rectifier bridge 32 which, in turn, is connected via the electrical cable 34 to the motor 26.

The treadle 14 is mechanically coupled to the transformer 28 by a linkage 36 attached at its upper end to a pulley crank, or link, 38 secured to the transformer rotor 40, the latter being rotationally biased by a return spring 42 to maintain tension on the linkage 36 and thereby return the autotransformer rotor to its zero position when the treadle 14 is released by the operator. As the treadle is depressed, on the other hand, the rotor 40 is moved to provide increasing power to the motor corresponding to the extent of treadle depression.

As will be explained in detail shortly, release of the treadle by the operator causes the motor to be dynamically braked to a stop, and also may bring the needle positioning means into play. Thus, as a line of stitches is completed, release of the treadle 14 will initiate two automatic operations: (1) braking of the motor and (2) positioning the needle to an up or down position, both operations taking place through control of the motor and without the electromechanical means previously necessary.

FIGS. 2–5 illustrate a bobbin winding mechanism which may be used advantageously with the direct-coupled motor arrangement of the invention. Thus, the motor 26 can be conveniently mounted to the machine by securing the cylindrical motor housing 27 to the machine housing 18 so that the drive shaft 20 and the motor shaft are coaxially aligned. An offset mounting is also possible, using gearing between those two shafts. The bobbin winding mechanism is activated during engagement of a rubber ring 44 at the periphery of a friction drive wheel 45 with a coupling 47, which interconnects the drive shaft 20 with the motor shaft 24. The drive wheel 47 rotates integrally with a shaft 48 that is journaled in the shank 50 extending at a right angle from the end of an arm 51 pivoted from a fixed hub 52 secured to the plate 27a. This shank moves along the arcuate path of the curved slot 54 in the plate as the arm 51 rotates.

The bobbin 56 is placed over the portion of the shaft 48 that protrudes from the forward side of the plate 27a and is locked to the shaft (as by a slot and key arrangement) so that it turns with the drive wheel and so that a feeler arm 58 is located between the flanges of the bobbin. Both the feeler arm 58 and a lug 60 are rigidly linked by a shaft 61 which turns freely within the hub of the arm 51. These two elements are biased toward the drive shaft by a spring 63 hooked between the lug post 60a and the fixed post 64.

During a winding operation, the thread (not shown) will be guided onto, and wound about the bobbin from a suitable supply source (also not shown). As the thread accumulates, the feeler arm 58 moves away from the bobbin hub until it reaches a point when the bobbin is full, at which time the feeler 58 will cause the drive wheel 45 to disengage the coupling 47. To keep the friction drive wheel in contact with the coupling, a tensioned spring 66 is connected between a fixed post 67 and an extension 68 of the arm 51. The spring 66 has a much smaller spring constant than the spring 63 and applies a relatively light contact pressure of the friction drive wheel 45 and the contact coupling 47.

Figure 2:
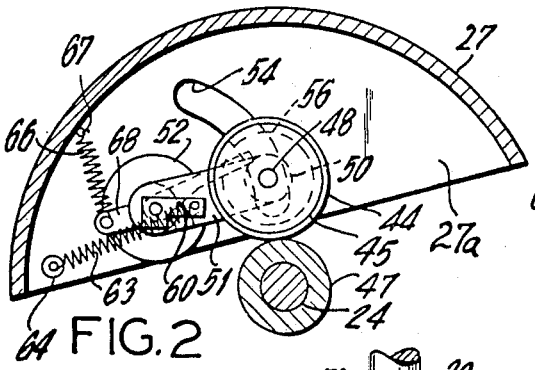
FIG. 2 is a side elevation view in partial cross-section of an improved bobbin rewind mechanism for use with the invention taken generally along the line 2—2 in FIG. 1 and showing the mechanism in the operating mode, with the bobbin in an unwound condition.
Figure 3:
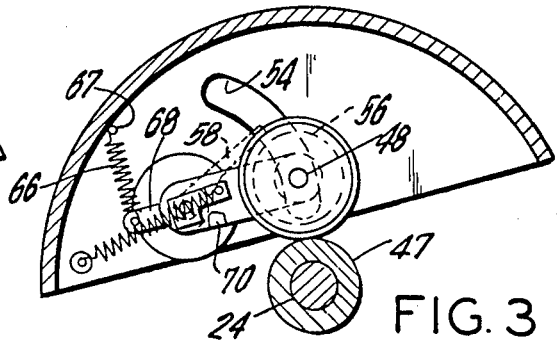
FIG. 3 is a partial cross-section, side elevation view similar to FIG. 2 showing the bobbin substantially rewound with the mechanism engaging a drive coupling.

As best seen in FIG. 2, the line of extension of the spring 3 falls to the side of the coaxial pivot point of the feeler 58 and the arm 51 so that, in the bobbin rewind position, with the bobbin empty, the spring 63 cooperates in holding the drive wheel 45 against the coupling 47. This is because the lug engages a shoulder 70 on the arm 51 and thus applies a clockwise rotational moment to the arm 51. However, as the thread accumulates on the bobbin, the feeler arm 58 moves counterclockwise until it reaches the position shown in FIG. 3. Thereafter, as the bobbin is filled to capacity, the lug 60 moved to a position where the line of extension of the spring 63 is on the other side of the pivot point for the arm 51, thus applying a counterclockwise rotational moment to the lug. The force of the spring 63 overcomes the force of the spring 66 and pulls up the lug 60, which now acts as a lever by engaging the shoulder in a manner to impart a moment to the arm 51, causing it to move along the arcate path of the slot 54 and thus disengaging the drive wheel from the rotating coupling. The bobbin may then be removed for use.

Figure 6:
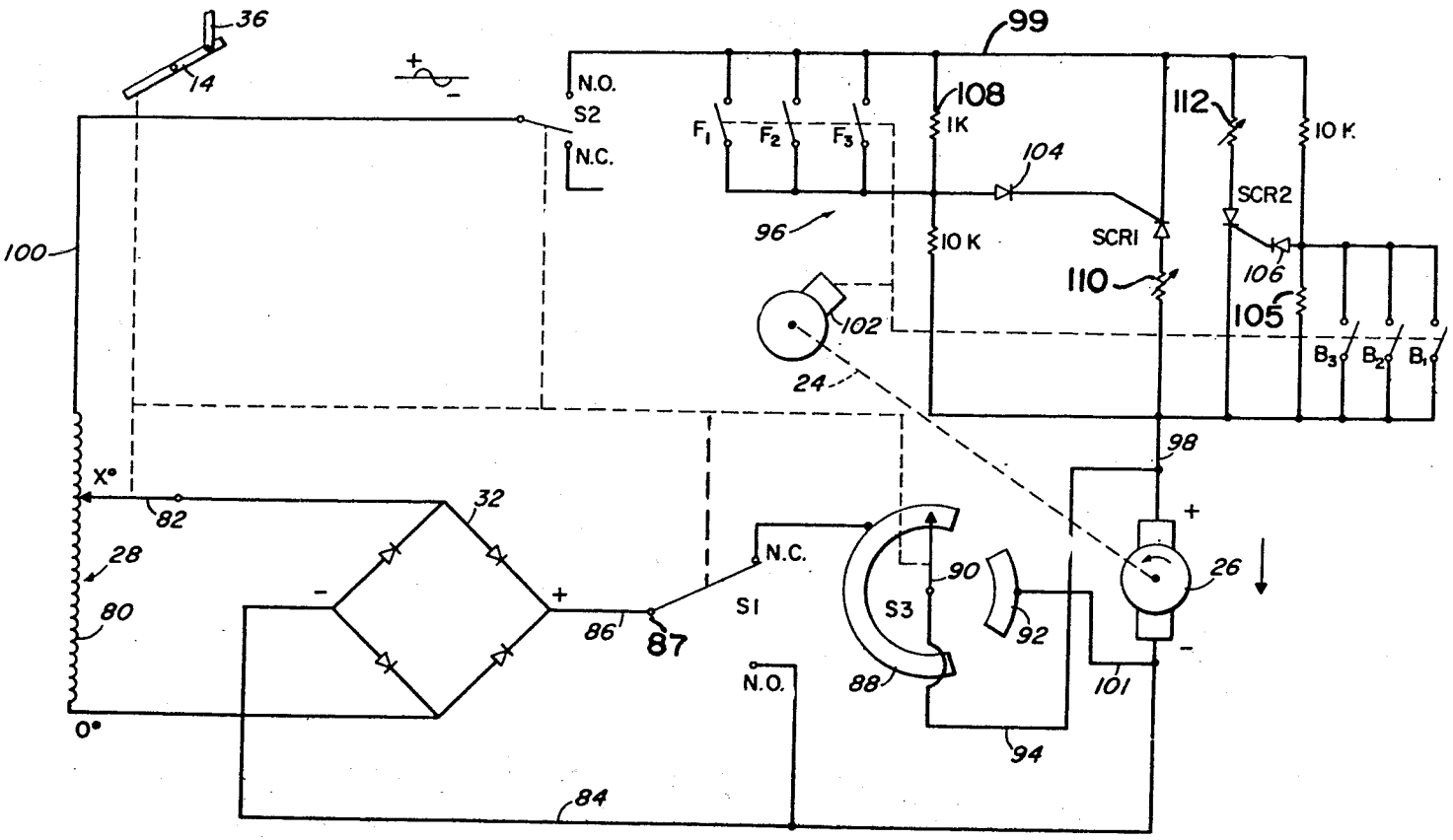
FIG. 6 is a schematic diagram of the novel direct drive control circuit according to the invention.
Figure 7:
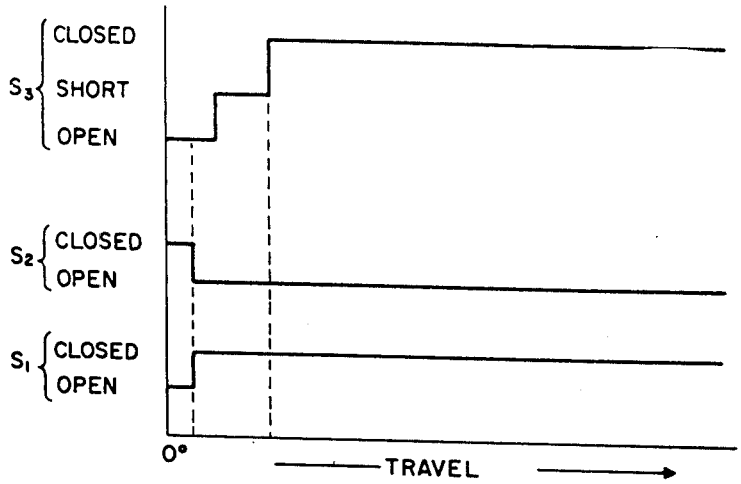
FIG. 7 is a graphical timing diagram indicating the open-close functions of the various switches in the circuit of FIG. 6 under different conditions.
Figure 8:
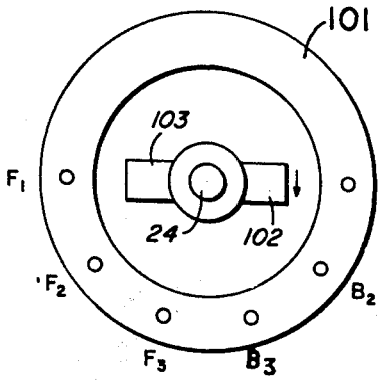
FIG. 8 is an end elevation view of the motor assembly, showing one preferred shaft position sensing arrangement.

Referring now more particularly to FIGS. 6, 7 and 8, the control circuitry will be described. As already noted, the variable source of voltage is developed by the autotransformer 28, which in practice may be of rotary configuration, comprised of inductive windings 80 connected to an AC power source (not indicated) and against which rides a wiper arm 82. This arm is coupled to the rotor 40 (FIG. 1) and its position is therefore controlled by the foot pedal 14. For purpose of illustration, the windings 80 are shown in linear fashion. It will be understood that as the operator depresses the treadle, the wiper arm 82 moves along the windings 80 to any position depending upon the speed desired by the operator by the degree of threadle movement, the speed range extending anywhere from a creeping motion to maximum speed.

It should be noted that the autotransformer is a low impedence source and, unlike rheostat controls, does not result in significant power losses as higher currents are drawn. As distinguished from the control circuits now used for stepping the motor in discrete speed increments, no resistive voltage dividers are needed.

The variable ac output at the wiper arm 82 is connected to the full-wave rectifier bridge 32, with a variable amplitude full-wave rectified signal appearing across the leads 84–86. It will be understood, of course, that this signal can be filtered if desired by inductive or capacitive elements to provide a cleaner dc signal to the motor. It is not necessary to do so, however, since the current is still unidirectional without filtering.

A switch S1 whose common terminal 87 is connected to the output of the rectifier by the lead 86 is coupled through mechanical elements to the foot treadle 14 (as indicated by the dashed line connection to the treadle). This switch is in the position shown (normally closed) for all positions of the treadle except the rest position whereupon the normally open (n.o.) contact is made to short the leads 84 and 86. See FIG. 7, lower graph. At the same time, of course, the wiper 82 is at the 0° position of the autotransformer so that no voltage is being applied to the rectifier.

With the switch in the normally closed (n.c.) position, the transformer output is applied to a rotary switch S3, the wiper 90 is in the gap segment) when the treadle is in the rest move about the arcuate segments 88, 92 and the gap between them. Anytime the wiper arm 90 contacts the longer section, the variable rectifier output is applied to the motor terminal 98, causing the motor 26 to drive in the forward direction. As indicated in the top graph of FIG. 7, the switch S3 is open (i.e., the wiper 90 is in the gap segment) when the treadle is in the rest position.

Although the switch S1 closes at 0° of autotransformer position, S3 remains open until the treadle is depressed slightly more so as to cause the switch to go into the motor-shorting condition with the wiper arm 90 contacting the brief arcuate segment 92. If the motor were running with the switch S3 in that condition, it is seen that the motor would be maximally loaded and thus dynamically braked by generator action. Moving the treadle slightly brings the wiper arm 90 to the major segment 88, where it remains for the remainder of treadle travel for operating the sewing machine. With the circuit in this condition, motor speed is controlled directly by treadle position and is continuously variable.

One motor found to provide good control, without the necessity for speed regulation of any kind to compensate for load variations during sewing, is the PMI Model U12M4. Preferably, the torque of the motor is selected to yield a mechanical time constant for the system which is less than 150 milliseconds and should not be so small that the time constant would exceed 500 milliseconds, if good response is to be obtained. Ideally, the time constant would be about 50 milliseconds or less. Sufficient starting torque is ensured by the operation of the switch S3, which slightly delays application of power to the motor until the autotransformer wiper has moved a small amount off the 0° position. Power is then applied abruptly to the motor 26 developing sufficient breakway torque to overcome the static friction of the system.

Rapid stopping of the machine occurs when the operator's foot pressure on the treadle is released. This causes the treadle to return toward the rest position and, as it does, the wiper 90 of the switch S3 contacts the sector 92, thereby shortcircuiting the armature of the drive motor 26 through the leads 94 and 101. Owing to the high torque characteristics of the motor, it slows to a stop almost immediately by dynamic braking action. Once the treadle is in the 0° position, the wiper of the switch S3 moves into one of the gap sections to remove all connection of the motor to the autotransformer and also to remove the shortcircuit of the motor. The switch S1 also opens at that time and a switch S2 closes to activate the needle positioning means. In a sense, therefore, closure of S2 provides a stop command which tells the positioning circuit to drive the needle to the desired position and then stop.

Referring again to FIG. 6, the drive control also includes a positioning circuit 96 by which pulses of both electrical polarities may be impressed upon the drive motor by means of the lead 98. Power to the circuit 96 arrives on the conductor 99 upon closure of the switch S2, which initially is closed (movable contact at terminal N.O.) when the operator's foot is off the treadle. Thus, when the treadle is returned to the normal position, the needle positioning circuit becomes operative, current being supplied to the feed conductor 99 of the positioning circuit. As earlier explained, it is the function of the positioning circuit to control the motor at the end of a sewing operation so that the needle obtains a predetermined final position. This position may be at top dead center or bottom dead center or any other intermediate position, as desired. When the operator depresses the treadle, on the other hand, the switch S2 opens (movable contact at N.C.) and stays open while the motor is operating so that no current is furnished to the positioning circuits.

In brief, the positioning circuit operates by delivering half-wave pulses to the motor as long as the needle falls outside of the desired position. Position is sensed by a plurality of forward switches F1, F2, F3 and backward switches B1, B2 and B3. These switches are mounted to a collar 101 attached to the motor housing and are disposed in an arc, as best shown in FIG. 8, about the motor shaft 24. The motor shaft carries a magnetic pole piece which rotates with the motor in proximity to the angularly spaced switches F1–F3, B1–B3. The pole piece 102 is counterbalanced by a non-magnetic member 103.

As observed from FIG. 8, the forward switches F1, F2 and F3 are located in the lower left-hand quadrant of the housing and the backward switches B1, B2 and B3 are located in the lower right-hand quadrant. In the illustrated embodiment, the forward and backward switches are glass switches which open and close in response to the magnetic field of the pole piece 102 as it is moving past each switch. Other types of position sensing arrangement, of course, may be used with the invention. Light-sensitive diodes in conjunction with a light source, and cam-operated switches, are examples of such alternatives.

In the positioning circuit 96, the position-sensitive switches control the signals applied to the control electrodes of switching devices SCR1 and SCR2 which interconnect the motor to the conductor 99. When running, the motor causes the magnetic pole piece 102 to rotate with it and, as it does, the switches F1–F3, B1–B3 open and close in sequence. During sewing, the treadle is depressed and S2 is thus open. Operation of the forward and backward switches have no effect on the system in this case because no power is applied to the conductor 99. When the pedal returns to the rest position, however, the switch S2 closes and the position-sensing switches become functional.

The positioning circuit 96 operates as follows:

Assume that the drive motor has been dynamically braked to a stop when the operator relieves pressure on the treadle, as described above, and that the motor stops in the position shown in FIG. 8 with the pole piece 102 opposite switch B1. The switch B1 will close to short the bias resistor 105, thus shorting the gate signal that is applied through the diode 106 to the gate electrode SCR2. Since the switches F1, F2 and F3 are open, a gating signal is derived across the reisitor 108 and SCR1 thus conducts to provide a negative half-wave drive signal to the motor 26. The motor runs clockwise so that, sequentially, switches B2 and B3 close so as to maintain SCR1 in the conducting mode. During this period of time, the motor is excited with a train of half-wave pulses, each separated by a half-wave period. Current through the motor may be regulated by the variable resistor 110.

If the pole piece 102 moves to the desired center position between the switches B3 and F3, the switch F3 will close to short the bias resistor 108 and extinguish the gating current supplied to SCR1 through the diode 104. With the switches B3 and F3 both closed, no drive pulses will appear at the motor terminal 98. If the motor should drive past the desired position, such that the switch B3 opens, SCR2 is conditioned for conduction by appropriately biasing its gate electrode. Positive half-wave drive pulses are thus applied to drive the motor in the forward direction (counter-clockwise), the current through SCR2 being adjustable by the resistor 112. Proper adjustment of the resistors 110, 112 will ensure the proper amount of torque so that the motor runs to the predetermined position without overshoot.

In alternative braking arrangements, a separate electromechanical brake may be connected to the motor, if desired, to aid in braking. However, such auxiliary braking is generally not necessary.

Of course, other switching logic is possible; for example, a unique condition of the switches might indicate the desired position. Also, the transition in switching between F3 and B3 may be detected to indicate that the drive means has passed through the reference point. In FIGS. 6 and 8, it should be obvious that the magnetically responsive switches can be of the normally closed type and connected serially so that a magnetic (or non-magnetic) rotating element would cause each switch to open when pulses are to be applied to the motor.

Figure 9:
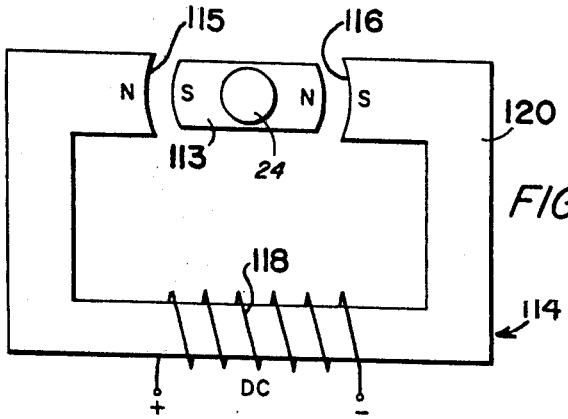
FIG. 9 is an end elevation view of the motor assembly and a magnetic torquing means useful in positioning the motor to a desired position.

FIG. 9 illustrates a modification of the self-positioning system, using auxiliary magnetic torquing means which does not require the position-sensing switches. As indicated, a permanent magnet 113 is mounted to the motor shaft 24 for rotation between the opposing pole faces 115, 116 of an electromagnet 114. The electromagnet is excited by current supplied to the winding 118 to establish flux in the core 120. When energized, the electromagnet, in conjunction with the rotor magnet 113, acts as a torquing motor.

Energization of the winding 118 occurs, for example, under the same conditions as for energization of the circuit 96. With the torquing arrangement of FIG. 7, however, direct current is connected to the winding 118 for needle positioning. The motor is then torqued by the resultant motor force until the permanent magnet is aligned with the pole faces 115, 116 bringing needle to the desired angular position. By appropriate switching, the poles may be reversed to change the position of the motor by 180°. The direction of rotation for needle positioning is thus selective in either a clockwise or counterclockwise direction.

It will be noticed in FIG. 1 that the unit includes a dial 122 by which the operator can control the distance between stitches. The dial is provided with settings graduated in stitches per inch with a fixed indicator mark on the motor housing. The machine housing 18 has the usual clutch-release button 123 which is depressed to turn the dial 122 to the desired setting.

Although the invention has been described with reference to specific embodiments, many modifications and variations may be made within the purview of the art. Some examples of alternatives have already been given. Other representative variations are changes in the shape of the pulses applied to the motor, in the switches or in the other means by which such pulses are gated or derived. Additionally, it is apparent that motion-responsive devices might be used to sense when the motor has once come to a stop and thereby to initiate operation of the positioning means.

While the variable speed motor and positioning circuit are shown in conjunction with a sewing machine, they may be used to advantage in other applications where a wide range of operating drive speeds are desired with simplified controls and means for stopping a motor effectively at the same angular position.

As another exemplary modification a variable transformer would be a suitable alternative to the autotransformer described. Accordingly, ass such modifications and variations are deemed within the scope of the invention as defined in the appended claims.

We claim:

1. A control system for a sewing machine and the like, having drive means connected to a motive source, comprising:

a direct current motor having a low inertial rotor mechanically coupled to the drive means of the machine;

switch means controllable by the operator for providing a stop command;

drive signal means including:

transformer means for developing a variable alternating current signal and manually operable means for controlling the transformer means to vary said alternating current signal and means for converting the alternating current signal into a variable unidirectional current, said drive signal means being disabled by the stop command;

needle position sensing means; and motor torquing means responsive to the stop command and the needle position sensing means for developing a limited duration torquing signal for driving the motor until the needle reaches a predetermined position when the drive signal means is disabled.

2. A control system as set forth in claim 1, wherein:

the motor torquing means provides a torquing signal of selectively opposite electrical polarities for direct application to the motor.

3. In a sewing machine including a drive member and a needle coupled to said drive member and reciprocatable thereby between raised and lowered positions, a direct current motor having a low inertia motor drive coupled to said sewing machine drive motor, a first dc power supply for energizing said motor including a variable ac output transformer and rectifier means for converting said transformer ac output to dc of a value responsive to the value of said ac output, manually operable means for controlling said transformer to vary said ac output between maximum and minimum values, a second dc power supply, means for sensing the displacement of said needle from a predetermined position and means responsive to said manually operable means for effectively disconnecting said first power supply dc output from said motor when said transformer is adjusted to its minimum ac output and connecting said second power supply dc output to said motor, and means responsive to said needle being at said predetermined position for minimizing the output of said second power supply whereby to stop said needle when it reaches said predetermined position.

4. The sewing machine of claim 3 wherein the direction of the dc current output of said second power supply applied to said motor is responsive to said needle position sensing means to drive said motor in a forward or reverse direction to respectively advance or retract said needle to said predetermined position.

5. The sewing machine of claim 3 including means for shorting said motor as said transformer is adjusted to its minimum output position.

* * * * *